US006726497B2

(12) United States Patent
Nogawa et al.

(10) Patent No.: US 6,726,497 B2
(45) Date of Patent: Apr. 27, 2004

(54) CONNECTOR FOR FLAT FLEXIBLE CABLE

(75) Inventors: Yoshiteru Nogawa, Machida (JP); Hideki Iijima, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/289,063

(22) Filed: Nov. 6, 2002

(65) Prior Publication Data

US 2003/0087544 A1 May 8, 2003

(51) Int. Cl.[7] ..... H01R 13/15; H01R 13/62
(52) U.S. Cl. ..... 439/260; 439/495
(58) Field of Search ..... 439/260, 261, 439/494, 495, 496

(56) References Cited

U.S. PATENT DOCUMENTS

| | | | | |
|---|---|---|---|---|
| 4,541,678 A | | 9/1985 | Lumpp | 439/260 |
| 4,576,427 A | | 3/1986 | Verbruggen | 439/592 |
| 5,173,058 A | | 12/1992 | Broeksteeg et al. | 439/267 |
| 5,542,855 A | | 8/1996 | Asai | 439/260 |
| 5,902,142 A | | 5/1999 | Kondo et al. | 439/267 |
| 5,906,498 A | | 5/1999 | Nagafuji | 439/260 |
| 6,206,723 B1 | * | 3/2001 | Kunishi | 439/495 |
| 6,471,541 B2 | * | 10/2002 | Kunishi et al. | 439/495 |

FOREIGN PATENT DOCUMENTS

| | | | |
|---|---|---|---|
| EP | 0 263 296 | 4/1988 | H01R/13/11 |
| JP | 10/208822 | 8/1998 | H01R/23/68 |
| JP | 10-214661 | 8/1998 | H01R/23/68 |
| JP | 11-31561 | 2/1999 | H01R/23/68 |
| JP | 11-307198 | 11/1999 | H01R/23/68 |

* cited by examiner

*Primary Examiner*—Hae Moon Hyeon
(74) *Attorney, Agent, or Firm*—Stephen Z. Weiss

(57) ABSTRACT

An FPC connector permits downsizing and not exerting residual stress on terminals irrespective of the pivoting position of an actuator while an FPC is not connected. The FPC connector is provided with biasing beams respectively arranged adjacent contact terminals disposed in an insulative housing. The biasing beams are pivotable about support points at intermediate portions thereof. The biasing beams are pivoted by means of pivotal actuator.

5 Claims, 2 Drawing Sheets

CONNECTOR FOR FLAT FLEXIBLE CABLE

FIELD OF THE INVENTION

The present invention relates generally to a connector for a flat printed circuit or a flat flexible cable which is typically referred to as FPC or FFC. Throughout the disclosure and claims, the wording "FPC" will be used to generally referred to both the flat flexible cable and the flat printed circuit.

DESCRIPTION OF THE RELATED ART

Conventionally, an FPC connector includes an insulative housing provided with an FPC insertion cavity and a plurality of contact terminals disposed within the insulative housing in a side-by-side relationship with a predetermined pitch. The terminals have contact portions which extend into the FPC insertion cavity. A pivoting actuator is disposed between contacts of the FPC and is designed to apply the necessary contact pressure to cause displacement of contact beams integrally formed with the contact terminals by pivotal motion thereof. Displacement of the contact beams is either for urging the contacts onto the conductors of the FPC or for widening an insertion gap for the FPC. Such FPC connectors are disclosed in U.S. Pat. No. 5,906,498, Japanese Unexamined Patent Publication No. Heisei 11-31561. Japanese Unexamined Patent Publication No. Heisei 10-208822 and Japanese Unexamined Patent Publication No. Heisei 10-214661.

As set forth above, displacement of the contact beams integral with the contact terminals by pivotal motion of the pivotal actuator causes resilient deformation of the contact terminals. Therefore, in order to permit pivotal motion of the pivotal actuator without requiring a large activation force, a relatively large arm is required to reduce the force needed to move the actuator so that sufficient force is provided to create an adequate electrical and mechanical engagement between the terminals and the FPC conductors. Therefore, the extra length serves as a hindrance for down-sizing of the FPC connector.

On the other hand, a stress is exerted on the contact terminal by pivotal motion of the pivotal actuator. It is possible that during a solder reflow process for mounting the FPC connector on the printed circuit board the stress which remains in the contact terminals can cause the characteristics of the terminal to change in the pressure of the heat. Also, since the force of the actuator is placed between the housing and the terminals, the housing must be larger to accommodate this extra force.

SUMMARY OF THE INVENTION

The present invention has been designed to solve the shortcomings set forth above. It is therefore an object of the present invention to provide an FPC connector which has a structure permitting down-sizing.

Another object of the present invention is to provide an FPC connector which has a structure not exerting residual stress on terminals irrespective of pivoting position of an actuator while an FPC is not connected and to not have the force of the actuator placed between the housing and the terminal thereby permitting former housing downsizing.

A further object of the present invention is to provide an FPC connector which has a structure to be easily designed for obtaining he necessary contact pressure.

In order to accomplish the above-mentioned objects, a connector releasably coupling, electrically and mechanically, connectors of a flat printed circuit according to the present invention is provided with an insulative housing defining an FPC insertion cavity. A plurality of terminal is held in said housing in a side by side relationship with contact beams extending in the FPC insertion cavity, the terminals each have a support post held to and extending away from the base. Extending laterally from the support post is a pivot point and a contact beam. A plurality of biasing beams arranged adjacent the terminals have a first end, a second end and a fulcrum point. A pivoting actuator including a shaft rotates within the pivot point of the terminals. The shaft has a cam which, when the actuator is in the down or locked position, engages the first end of the biasing beam causing the biasing beams to rotate about their fulcrum points moving the second end into contact with the FPC whereby the FPC is in electrical engagement with the terminals and the FPC is tightly held mechanically between the terminals and the biasing beams.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscurity of the present invention.

Figure 3:
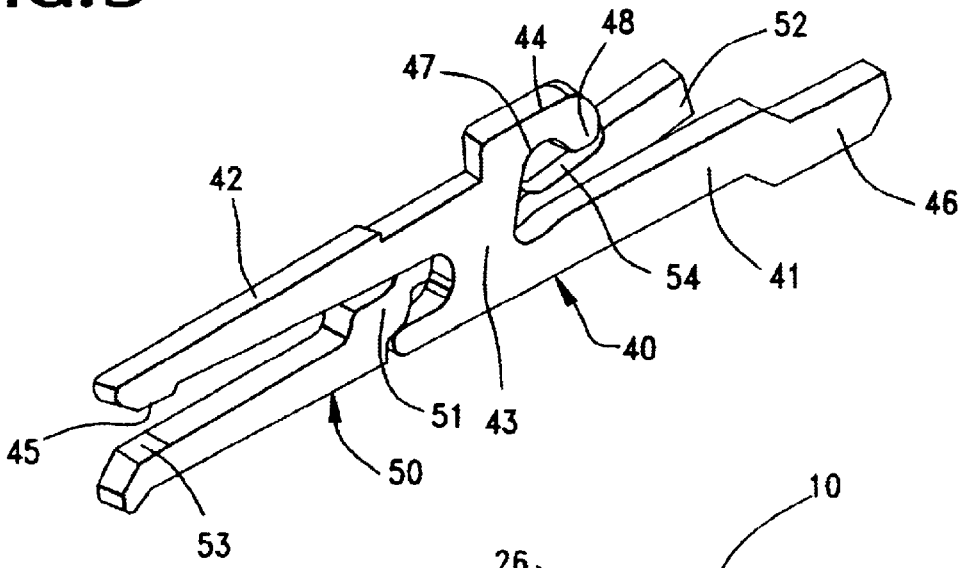
FIG. 3 is a perspective view of a contact terminal and biasing beam forming the preferred embodiment of the FPC connector of the present invention.

The preferred embodiment of an FPC connector 10 has an insulative housing 20 formed of an insulative plastic and a pivotal actuator 30. In the insulative housing 20, a plurality of contact terminals 40 and biasing beams 50 are loaded in side-by-side relationship at a predetermined pitch. These contact terminals 40 and biasing beams 50 are formed by stamping a thin metal blank. As shown in FIG. 3, adjacent individual contact terminal 40 and individual biasing beams 50 are combined in a scissors-like form.

Figure 2:
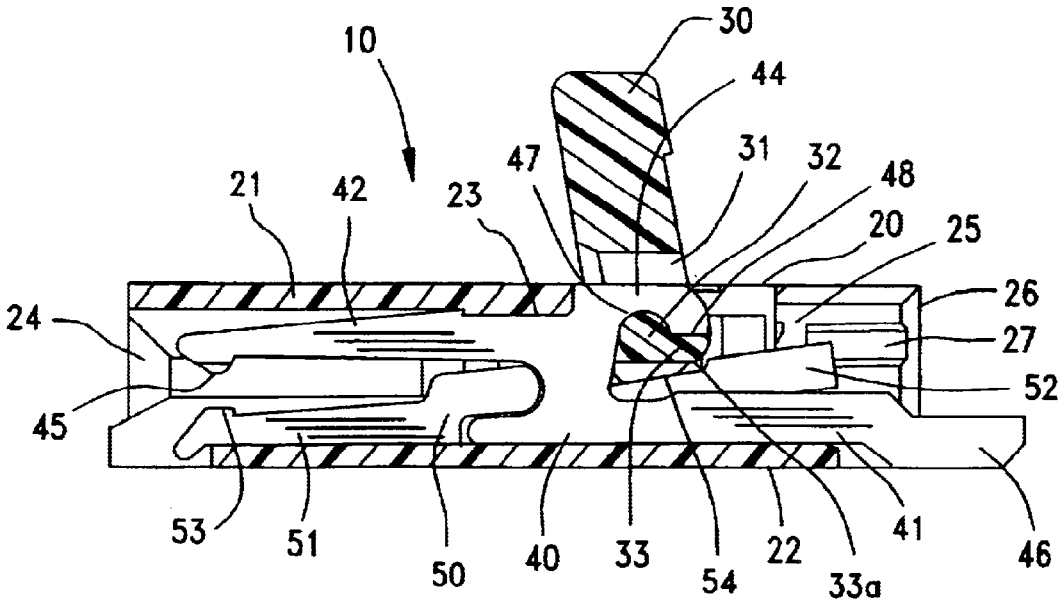
FIG. 2 is a side view of the section of the preferred embodiment of the FPC connector shown in FIG. 1.

The insulative housing 20 has a top plate 21 and a bottom plate 22. Between the top plate 21 and the bottom plate 22, a plurality of terminal receptacle cavities 23 are defined. In FIG. 2, the contact terminals 40 and the biasing beams 50 can be loaded from the rear. In FIG. 2, an FPC insertion cavity 24 opening to the front end is defined for receiving an end portion of an FPC 60 (see FIG. 5).

Each contact terminal 40 had a base 41 extending along the bottom plate 22 of the insulative housing 20 and a contact beam 42 extending in an upper side of the FPC insertion cavity 24 in cantilever fashion, and a support post 43 integrally interconnecting the base 41 and the contact beam 42. On the upper end of the support post 43, a pivot point 44 in the form of a hook portion is provided. The hook portion 44 is located and exposed in the back side of the top plate 21 of the insulative housing 20 so that the pivotal actuator 30 may pivot without interference.

The upper end of the contact beam 42 has a thickened portion. This thickened portion is located so that a clearance is formed between the top of the thickened portion and the lower surface of the top plate 21 of the insulative housing 20. The resulting tapered contact beam 42 may have spring characteristics as elastically deformed toward the top plate 21. Formed on the lower edge of the tip end portion of the contact beam 42, is a contact projection 45.

The base 41 of the terminal 40 extends parallel to the upper surface of the bottom plate 22 of the insulative housing 20 so that it may contact with the bottom plate 22 in substantially its entire length. The base 41 has a length projecting rearwardly beyond the bottom plate 22 to form a solder tail 46 lying substantially flush with the lower surface of the bottom plate 22.

Figure 1:
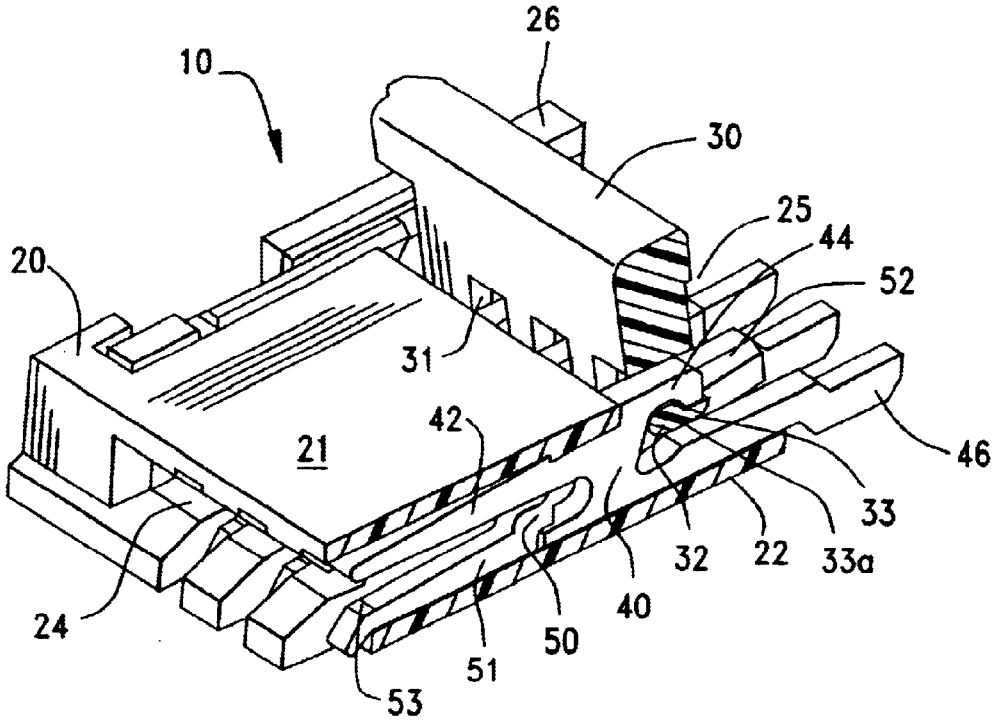
FIG. 1 is a partially cut out perspective view of the preferred embodiment of an FPC connector according to the present invention, which is illustrated in a condition before connection with an FPC.
Figure 4:
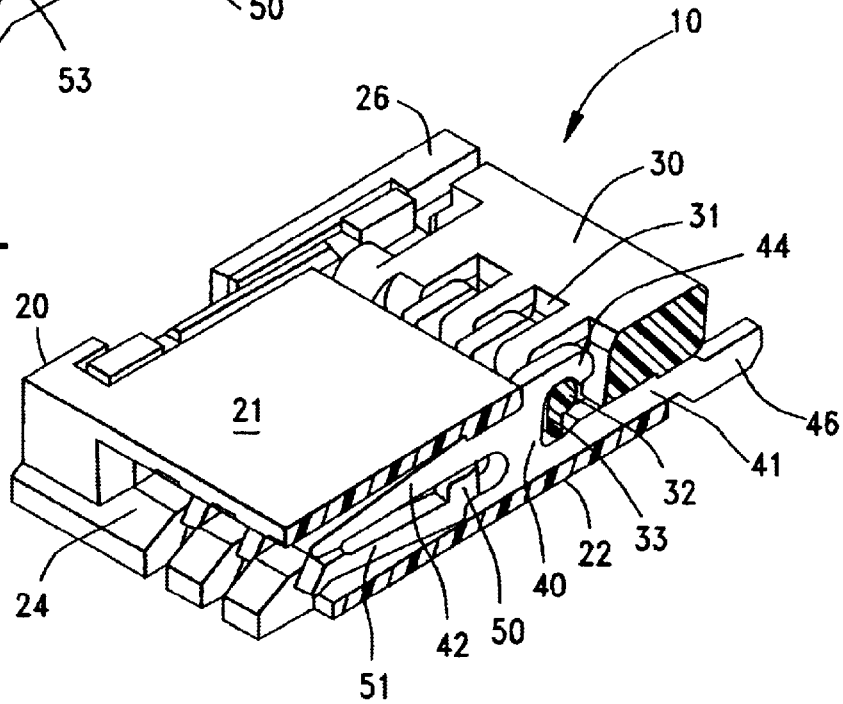
FIG. 4 is a partially cut out perspective view of the preferred embodiment of the FPC connector according to the present invention, which is illustrated in a condition where the FPC is connected (the FPC is not shown)
Figure 5:
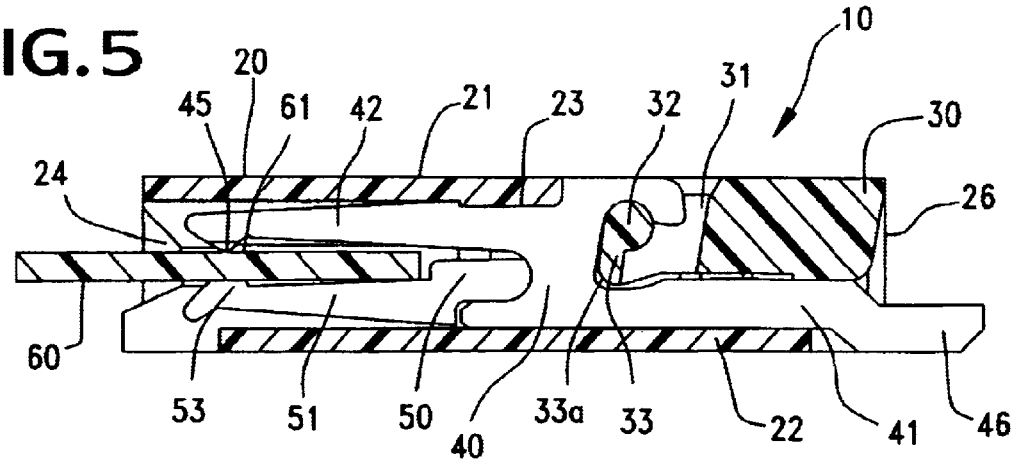
FIG. 5 is a side view of the section of the preferred embodiment shown in FIG. 4 with the FPC in place.

The biasing beams 50 are placed adjacent respective of the contact terminals 40. Each biasing beam 50 includes a second end 53 extending toward the FPC insertion cavity 24 of the insulative housing 20 and a first end 52 extending along the base 41 of the contact terminal 40. Each biasing beam is pivotably supported by the fulcrum point 51. As shown in FIGS. 1 and 2, when the biasing beam 50 is in a free condition, it is substantially parallel with the bottom plate 22 of the insulative housing 20, and the first end 52 is lifted upwardly. As shown in FIGS. 4 and 5, when the first end 52 is substantially parallel with the bottom plate 22, the second end 53 is lifted upwardly.

Fulcrum point 51, joining the ends 52 and 53, is bent in a vertical plane to joint both ends in an angled relationship so that the biasing beam 50 may pivot over the base 41.

In the shown embodiment, the biasing beam 50 is formed by stamping a thin metal blank to have electrical conductivity. However, the biasing beam may be formed of an insulative plastic as non-conductive member.

The pivotal actuator 30 has a shape and size to be received within an actuator receptacle portion 25 defined on the rear end of the insulative housing 20. The actuator 30 is formed with a plurality of window openings 31 at positions respectively corresponding to the positions of the hook portions 44 of the contact terminals 40. By inserting respective hook portions 44 into the window openings 31, interengagement between the pivotal actuator 30 and the contact terminals 40 is established for permitting pivotal movement of the actuator 30. The lower edge of the hook portion 44 is formed into a semi-circular engaging edge 47. A shaft 32 is received within this engaging edge 47. Thus, the pivotal actuator 30 is pivotable between the substantially vertical position as illustrated in FIGS. 1 and 2 and the substantially horizontal position as illustrated in FIGS. 4 and 5.

A cam projection 33 extends from the shaft 32. An arc-shaped cam face **33*a* is formed on the lower surface side of the cam projection 33. The arc-shaped cam face 33*a* is formed over the entire width of the pivotal actuator 30. On the upper edges of the first end 52 of the biasing beam 50 opposing the cam face 33*a*, is a recessed portion 54. This recessed portion provides a smooth sliding surface with cam face 33*a***.

When the pivotal actuator 30 is pivoted to the vertical position, as shown in FIGS. 1 and 2, the cam projecting piece 33 of the shaft 32 engages abutment 48 at the tip of the hook portions 44 to stop pivotal motion. When the pivoting actuator 30 is pivoted to a substantially horizontal position, as shown in FIGS. 4 and 5, the lower surface of the pivoting actuator 30 contacts the upper edges of the base 41 of the contact terminals 40 to stop pivotal motion. Both side edges of the pivotal actuator 30 engage with engaging portions 27 provided in the side walls 26 of the insulative housing 20 defining the actuator receptacle portion 25 to maintain the pivotal actuator 30 in the substantially horizontal condition.

When the pivotal actuator 30 is pivoted to a substantially vertical position, the cam projection 33 is released from the first end 52 of the biasing beam 50 to open the distance between contact 45 and contact tip at the second end 53 on the biasing beam. This opening will facilitate the insertion of the FPC 60 into the connector through the FPC insertion cavity 24 with little or no resistance.

After insertion of the FPC 60, the pivoting actuator 30 is pivoted to the substantially horizontal position. Movement of the cam projection 33 slidingly moves the cam face **33*a* onto the upper edges of the movable beams 52 of the biasing beams 50. According to this pivotal motion, the first ends 52 are moved downwardly. In conjunction therewith, the second ends 53 move the FPC 60 inserted into the housing toward the contact beams 42 to cause engagement between the contacts 45 of the contact beams 42 and the contacts 61 of the FPC with a contact pressure necessary for establishing electrical connection. Thus, the contacts 45 and the contacts 61** are urged toward each other as if vertically biased by means of springs to reliably establish electrical connection.

In the prior art, the beam which engages the FPC is pivoted via elastic deformation which requires a greater force applied to the terminal because the subject invention does not require as much force since there is no elastic deformation. Therefore, the length of the biasing beams 50 can be shorter to permit the depth of the FPC connector in the insertion direction of the FPC to be shorter. In the preferred embodiment, the biasing beam 50 has a length extending backwardly beyond the recessed portions 54 located opposite to the cam face **33*a*. However, the length of the movable beams 52 can be shortened to terminate at the position corresponding to the recessed portion. Corresponding to this, the base 41 of the contact terminals 40** can be shortened for downsizing.

In the condition where the FPC 60 is not inserted into the FPC connector 10, at any position of the pivotal actuator 30, particularly, even if the pivotal actuator 30 is in substantially horizontal position as shown in FIGS. 4 and 5, no stress will be exerted on the contact terminals and the biasing beams 50. Accordingly, when the FPC connector 10 is fed into a solder reflow process for mounting the FPC connector 10 on the printed circuit board, heating can be performed without stress placed on the terminals which stress combined with heat could change the characteristics of the metal. Accordingly, the spring performance will not be changed.

In an alternative embodiment, it is possible to construct the connector by arranging the biasing beams on the side of the top plate 21 of the housing and the contact beams of the contact terminals on the side of the bottom plate 22 of the housing. In such case, the contacts formed at the tip end of the contact beams and the contact formed on the lower side of the FPC are urged toward each other to establish electrical connection with a necessary contact pressure.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

We claim:

1. An electrical connector releasably coupling, electrically and mechanically, conductors of a flat printed circuit (FPC) comprising:

an insulative housing defining an FPC insertion cavity, a plurality of terminal held in said housing in a side by side relationship with contact beams extending in said FPC insertion cavity;

said terminals each having a support post held to and extending away from said base extending laterally from said support post is a pivot point and a contact beam;

a plurality of biasing beams arranged adjacent said terminals having a first end, a second end, and a fulcrum point; and a pivoting actuator including a shaft designed to rotate within the pivot point of the terminals, the shaft having a cam which, when the actuator is in the down or locked position, engages the first end of the biasing beam causing the biasing beams to rotate about their fulcrum points moving the second end into contact with the FPC whereby the FPC is in electrical engagement with the terminals and the FPC is tightly held mechanically between the terminals and the biasing beams.

2. The electrical connector of claim 1 wherein the biasing beams are bent at said fulcrum point so that the fulcrum point is located over a portion of the terminal base.

3. The electrical connector of claim 1 wherein the pivot point is an arm extending from the support post in a direction opposite to the contact beam.

4. The electrical connector of claim 3 wherein the pivot point arm has a hook shape and said cam has a shape coinciding with a portion of the hook shape which engage one another preventing the actuator from rotating beyond a preset open position.

5. The electrical connector of claim 1 wherein both the terminals and the biasing beams are formed from metal.

* * * * *